United States Patent [19]

Rich

[11] Patent Number: 4,686,326

[45] Date of Patent: Aug. 11, 1987

[54] WIRE TERMINAL

[76] Inventor: Donald S. Rich, 15 Buttonwood Dr., Long Valley, N.J. 07853

[21] Appl. No.: 826,801

[22] Filed: Feb. 6, 1986

[51] Int. Cl.[4] ..... H01R 4/22

[52] U.S. Cl. ..... 174/87; 174/84 S

[58] Field of Search ..... 174/87, 84 S, 203

[56] References Cited

U.S. PATENT DOCUMENTS

| | | | |
|---|---|---|---|
| 3,075,038 | 1/1963 | Schinske | 174/87 |
| 3,440,332 | 4/1969 | Blomstrand | 174/87 |
| 3,678,174 | 7/1972 | Ganzhorn | 174/87 X |
| 3,875,324 | 4/1975 | Waddington et al. | 174/87 |
| 4,288,657 | 9/1981 | Swanson | 174/87 |

FOREIGN PATENT DOCUMENTS

| | | | |
|---|---|---|---|
| 654131 | 4/1929 | France | 174/87 |

*Primary Examiner*—Morris H. Nimmo
*Attorney, Agent, or Firm*—Robert K. Tendler

[57] ABSTRACT

An improved wire terminal is provided in which an internal coiled spring wire clamping member is opened with the usual clockwise twist of the wire terminal when wires are inserted into the wire terminal, with an intermediate portion of the spring initially contacting the wires as they are inserted into the wire terminal such that the clockwise rotation opens an upper spring portion anchored at its end to the wire terminal. In one embodiment, the portion of the spring contacting the inserted wires is open at the top and has a parallel running portion, such that with the wires held in position manually, the rotation in the clockwise direction permits further insertion of the wires up through the parallel portion of the spring and into a cavity at the top of the wire terminal. Release of the wire terminal causes the spring to collapse on itself to squeeze the wires together, thereby preventing dislodging of the wire terminal as by vibration. The wire terminal assembly includes a housing having an interior portion which is enlarged to accommodate the expansion of the internally carried spring, and in one embodiment, includes inwardly-projecting tabs adapted to contact the inserted wires to further prevent the wires from coming out of the wire terminal once inserted.

10 Claims, 7 Drawing Figures

WIRE TERMINAL

FIELD OF THE INVENTION

This invention relates to methods and apparatus for joining electrical conductors or wires, and more particularly, to a wire terminal which includes a coiled spring clutch mechanism for initially permitting the insertion of wires into an expanded spring portion followed by collapse of this spring portion on the wires to provide for the electrical connection.

BACKGROUND OF THE INVENTION

One of the basic problems with conventional wire terminals is that they are subject to default through vibration. This means that in a building where many wire terminals may be used, and in particularly in industrial type buildings, ambient vibrations in the structure are present which are induced by, for instance, air conditioning, heating or other machinery. Conventional wire terminals, because they have a tapered-type design in which a number of wires are forced together and wedged in a cap-held conical spring, have a tendency to come off due to vibration in which the terminal rotates counter-clockwise over time. If the terminal does not come off, it can loosen up, and as a result, the electrical integrity of the connection is compromised. This produces hot spots and other types of faults which sometimes can be particularly difficult to trace.

Moreover, in conventional wire terminals, the plastic insulating outer housing works as a tight girdle to restrain the tapered helical spring electrical member from expanding in a radial direction. This spring is basically seated against the outer walls of the insulator and is prevented from movement in any direction. Moreover, the spring has a closed end which limits how far the wires can be pushed into the terminal. The closure of the spring at one end does not permit accommodation of a broad range of wires, and since the spring is unable to move radially, it cannot adjust properly to the number of wires which have been inserted, thereby even further limiting the size and range of wires to be connected. Moreover, by its very construction, the conventional wire terminal also tends to create a tapered helical girdle into which the wires are inserted which produces a force component which attempts to push the wires out of the wire terminal.

SUMMARY OF THE INVENTION

In counter-distinction to the conventional wire terminal described above, the subject wire terminal includes a terminal housing which contains a helically wound electrically-conductive spring which is allowed to expand radially inside the wire terminal body with clockwise rotation of the terminal. In one embodiment, the portion of the spring which contacts the inserted wires is, in general, parallel in construction as opposed to being tapered as is conventional. This provides that wires inserted into the wire terminal are held by a spring member which grasps the wires in a direction normal to the longitudinal centerline of the wires such that they are not pushed out or such that the connection does not involve an axially downward force.

More particularly, the upper end of the spring of the subject invention is anchored in a slot or tab-like structure within the wire terminal housing such that when wires are held stationary and are inserted into the wire terminal, a portion of the wires contact a lower portion of the spring, and when the wire terminal is turned clockwise then, in one embodiment, the upper portion of the spring opens, allowing further upward insertion of the wires through the expanded portion of the spring assembly. Upon release, the spring closes down upon the inserted wires, due to its spring memory, and holds the wires together in electrical contact along an extended parallel path. As such, the design resembles a spring-wound clutch in the sense that when a group of wires are applied to it, the wires may be inserted very easily with a clockwise terminal rotation, whereas counter-clockwise rotation due to the relaxing of the spring resists the tendency for the wire terminal to come off because once released the counter-rotation of the terminal causes the spring tension to increasingly grip the wires and tighten the connection.

In one embodiment, the top portion of the spring member is open so that wires may be forced through the spring and into a cavity at the top of the wire terminal housing. This permits the handling of various lengths of exposed wire such that if too much insulation has been cut off from the wire, it can be taken up within the wire terminal cavity at the top of the wire terminal.

It will be appreciated that the wire terminal housing provides clearance for the internally-carried spring to expand in a radial direction, thereby to permit ease of insertion of the wires to be connected. With each clockwise turn of the wire terminal, the spring is further expanded to permit even further insertion of the wires. Thus, there is no education required with respect to the operation of the terminal since, as far as the user is concerned, it operates in the same manner as the conventional wire terminal.

The wire terminal described above can accommodate a broader range of wires since space is provided between the outer walls of the spring and the inner walls of the terminal housing so that the spring can expand or contract to adjust appropriately to the number of wires which have been inserted. The contact area is both helical and parallel so that a longer length of the inserted wire is contacted. Since there is a parallel portion to the spring, which is the portion of the spring performing the clamping, there is no force component which is attempting to push the wires out of the wire terminal. Thus, the effect of the parallel portion of the spring is neutral and aids the wire terminal in retaining the wires.

In a further embodiment, the wire terminal is provided at its base with inwardly-projecting flexible tab portions which are utilized, in addition to the action of the wire terminal, to prevent the wires from coming out of the wire terminal once they are inserted. These tabs may contact either the wires themselves or the insulating outer jacket surrounding the wires. The tabs which project inwardly at the base aperture of the wire terminal are integral to the rest of the wire terminal, in one embodiment, for ease of fabrication.

In summary, an improved wire terminal is provided in which an internal coiled spring wire clamping member is captured in the terminal body and is opened with the usual clockwise twist of the wire terminal when wires are inserted into the wire terminal, with an intermediate portion of the spring initially contacting the wires as they are inserted into the wire terminal such that the clockwise rotation opens an upper spring portion anchored at its upper end to the wire terminal. In one embodiment, the spring is open at the top such that further insertion of the wires pushes the wires up through the parallel portion of the spring and into a cavity at the top of the wire terminal. Release of the wire terminal causes the spring to collapse on itself to squeeze the wires together, thereby preventing dislodging of the wire terminal as by vibration. The wire terminal assembly includes a housing having an interior portion which is enlarged to accommodate the expansion of the internally-carried spring, and in one embodiment, includes inwardly-projecting tabs adapted to contact the inserted wires to further prevent the wires from coming out of the wire terminal once inserted.

BRIEF DESCRIPTION OF THE DRAWINGS

These and other features of the subject invention will be better understood when taken in conjunction with the Detailed Description in view of the following drawings, of which.

DETAILED DESCRIPTION

Figures 1A, 1B, 1C:
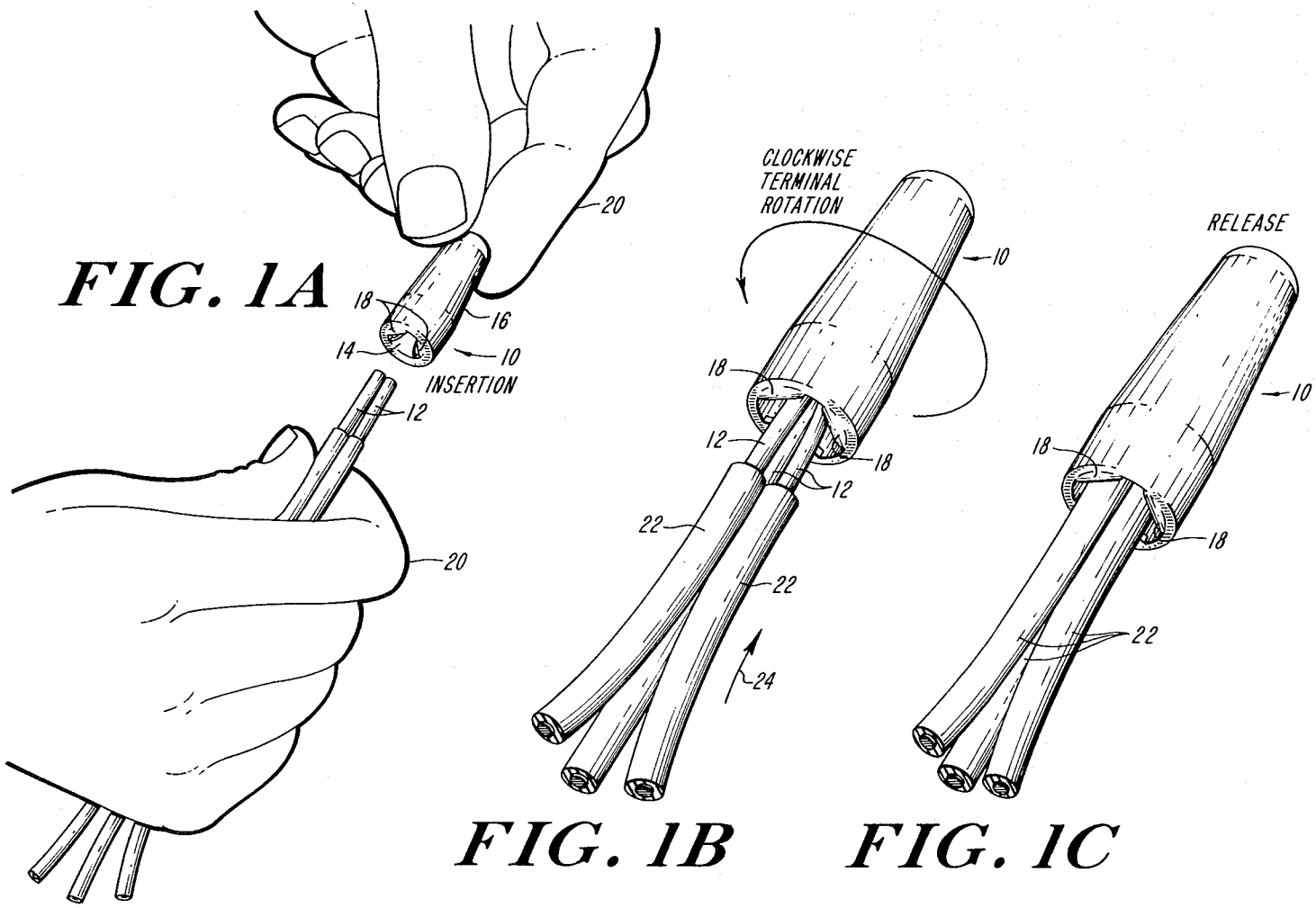
FIGS. 1A, 1B and 1C are diagrammatic illustrations of the utilization of the subject wire terminal through respective stages of insertion clockwise terminal rotation and release of the terminal.

Referring now to FIG. 1A, a wire terminal 10 is utilized to join a number of conductors or wires 12 by virtue of the manual insertion of wires 12 into orifice 14 of electrically non-conductive wire terminal housing 16, with housing 16 having integral and flexible tabs 18 which serve to retain the wires in the terminal once the terminal has been secured to the wires. The manual insertion is indicated by portions 20 of hands which are utilized in the manual procedure.

Referring to FIG. 1B, once the wires 12 have been inserted into terminal 10, the terminal is rotated in the usual clockwise direction, while at the same time, wires 12 along with outer insulation 22, if any, is forced upwardly in the direction of arrow 24 so as to force the wires into the terminal during the clockwise rotation. As will be described in connection with FIG. 2B, the clockwise rotation opens the internally carried spring member to permit the wires to be easily inserted into the wire terminal rather than the spring being captured in the wire terminal housing and being unable to expand, as is the case conventionally.

Upon insertion of the wires into the wire terminal and the clockwise rotation, release of the wire terminal causes the collapse of the internal spring upon itself which, as will be described hereinafter, presses the electrical conductors together along an extended line in such a manner that they will remain within the wire terminal, with any vibration causing tightening of the spring structure around the conductors so that an extremely stable electrical connection is made, which connection is only strengthened in the presence of vibration. How this is accomplished is described in connection with FIGS. 2A–2C and FIG. 3.

Figure 2C:
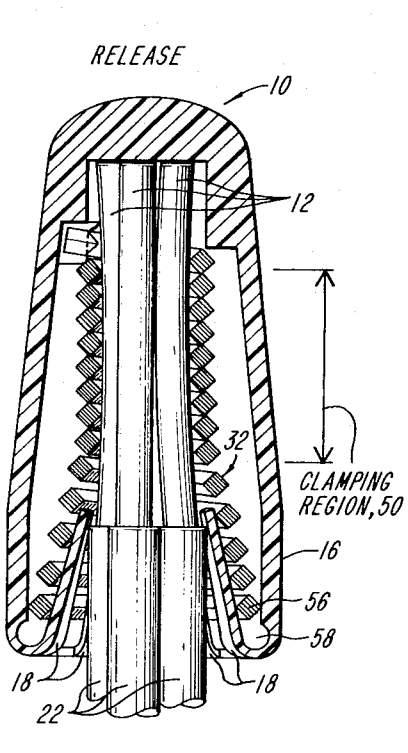
FIGS. 2A, 2B and 2C are respectively cross-sectional illustrations of the wire terminal of FIGS. 1A–1C, illustrating the interior open-ended spring configuration utilized in the wire terminal housing, the locking of the top end of the spring to the wire terminal housing, the top clearance for wire insertion in the top of the wire terminal and the spring tabs which are integral to the wire terminal housing for maintaining the inserted in the the wire terminal, with FIG. 2A indicating a parallel portion of the interior spring in its unexpanded condition, with FIG. 2B indicating the spring expansion due to terminal rotation which permits insertion of the wires into the wire terminal, and with FIG. 2C indicating the collapse of the parallel portion of the spring about the inserted wires upon release of the wire terminal.
Figure 2B:
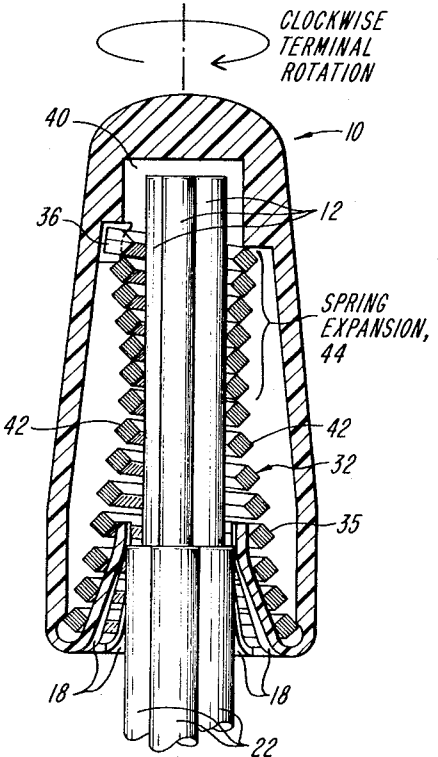
Figure 2A:
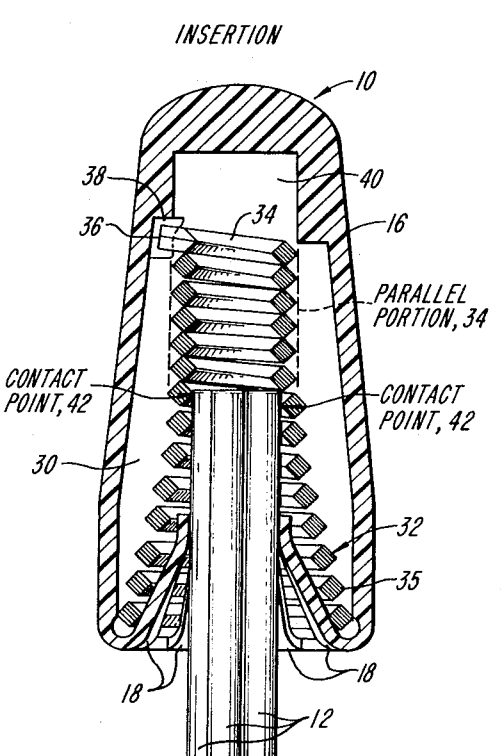

Referring now to FIG. 2A, wire terminal 10 is shown in cross-section as having a housing 16 with an internal cavity 30 which captures a clockwise helically wound spring 32, having a parallel portion 34 and a conical lower portion 35, as illustrated. It will be noted that spring 32 is opened at its top 34 and has an end 36 which is captured in a mating slot or tab 38 in housing 16.

It will also be noted that housing 16 is provided with a cavity 40 into which wires or conductors 12 may be inserted, if so desired, such that the subject terminal does not limit to any great extent the ability to insert stripped wires therein.

Referring to FIG. 2A, wires 12 are shown inserted to a point of contact with spring 32 intermediate its length and generally at the bottom end of the parallel portion 34, with the contact point here being illustrated by arrows 42. Note that the top of spring 32 is open-ended in one embodiment. When wires 12 are held in one position, it will be appreciated that the contact point 42, even if momentary, serves as a fixed point such that, as illustrated in FIG. 2B, when the terminal is rotated clockwise, end 36 also rotates clockwise so that spring 32 expands above point 42, as illustrated by the expanded portion 44 of the spring. The clockwise rotation of terminal 10 therefore provides that the upper portion of the spring expands radially so that wires 12 can be inserted completely through the parallel portion of the spring and into cavity 40 if such is desired.

It will be appreciated that with the wires being held stationary, the twisting of the wire terminal expands the upper portion of the spring radially since there is at least momentary contact between the stationary wires and an intermediate portion of the spring. This contact, even if it is only momentary, is enough to expand the spring until the next clockwise turn of the wire terminal. Thus, with each clockwise turn of the wire terminal, the stationarily-held wires can be advanced into the terminal. The momentary contact of the stationary wires at the lower end of the parallel portion of the spring is, in part, due to the initial impulse imparted during a rapid twist of the wire terminal which momentarily opens the upper portion of the spring with each twist.

Thus, the spring expansion is caused by the rotation of end 36 in the clockwise direction since it is captured in slot 38 in housing 16 of the wire terminal and since it is rotated with respect to certain momentary points of contact 42. Tab 38 is in effect a drive element for imparting rotational torque to the spring from the terminal housing.

Figure 3:
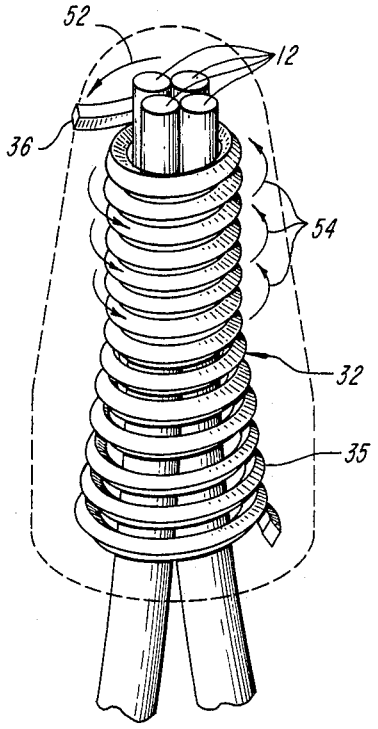
FIG. 3 is a diagrammatic illustration of the release of the spring where it contracts upon itself to squeeze the inserted wires together and into electrical contact.

Upon release of the spring, as illustrated in FIG. 2C, the parallel portion collapses upon itself, as illustrated in area 50, forming a clamping region which clamps wires or conductors 12 together. This clamping operation is shown in FIG. 3 in which end 36 moves counter-clockwise in the direction of arrow 52 such that the spring springs back on itself as illustrated by arrows 54 around conductors or wires 12.

As can be seen in each of these drawings, not only is there parallel contact by the spring with respect to the inserted wires over an extended distance, there is no tapering which would tend to force the wires out. Thus, in the subject wire terminal, all applied forces are normal to the longitudinal centerlines of the wires. As a result, during any vibration or motion, the spring simply tightens around the wires as opposed to loosening or the wire terminal coming off. The result is that the current building code requirements for taping of wire terminals to wires in commercial establishments can be relaxed.

In order to aid in the stability of the entire wire terminal system, the wire terminal may optionally be provided with the aforementioned integral tabs 18 which are adapted to contact either conductors 12 or their insulating sleeves or jackets 22 such that, in addition to the clamping action of the spring, the terminal it also further held in place on the wires by virtue of the integral tabs and provide additional strain relief. As illustrated, the tabs are integral in the sense that they extend from the bottom periphery of the terminal housing 16 and extend upwardly and inwardly. These tabs may be provided with teeth or other locking means (not shown) as desired.

The spring member itself can be loosely carried within the terminal housing as long as end 36 is within its mating slot 38 and, in one embodiment, the opposite end of the spring, e.g., end 56, is free to move in the cavity 58 at the bottom of the wire terminal housing. As can be seen, the subject wire terminal thus responds to vibration and other movement by tightening on the wires which it is intended to connect as opposed to loosening the connection, with the open-endedness of the spring along with the upper terminal cavity provided permitting insertion up into the wire terminal of the conductors or wires of greatly differing lengths. Thus, the length of wire stripped is not so critical. Note that the wire terminal housing is hollow enough to permit radial movement of a portion of the spring so that the spring may expand in a radial direction during the clockwise terminal rotation.

It will be apparent that were the spring wound in the opposite direction, then a counter-clockwise movement of the terminal would serve the same spring expansion function as illustrated. As such, springs would in an opposite direction and counter-clockwise twisting are within the scope of this invention. However, a clockwise motion has been described as the preferred embodiment because it is this motion which is most normally associated with providing wire terminals at the terminus of conductors to be joined together.

Having above indicated a preferred embodiment of the present invention, it will occur to those skilled in the art that modifications and alternatives can be practiced within the spirit of the invention. It is accordingly intended to define the scope of the invention only as indicated in the following claims.

I claim:

1. A wire terminal for the electrical connection of wires or conductors comprising:

an electrically non-conductive housing having an interior cavity, and an apertured base and slot at the top of said cavity;

a helical spring having a top end permanently retained in said slot such that torque is always transmitted to the top end of the spring upon insertion of wires into said terminal and upon a twist of said terminal in a predetermined direction, and, space between said housing and an intermediate portion of said spring to permit expansion upon insertion of wires, such that upon first twist of said terminal an upper portion of said spring expands radially within said cavity upon at least momentary contact between the inserted wires and an intermediate portion of said spring thus permitting further insertion of the wires, and such that upon release of said terminal, said spring collapses down upon the inserted wires for a tight secure connection along a number of turns of said spring such that there is contact by said spring with respect to the inserted wires over an extended distance, the bottom of said spring being free to move rotationally at least to a limited extent.

2. The wire terminal of claim 1 wherein a top portion of said helical spring is open-ended and wherein said housing has a cavity portion above the top portion of said spring to accommodate wires passing through said spring.

3. The wire terminal of claim 1 wherein the top of said spring has parallel sides to permit extended spring contact with inserted wires.

4. The wire terminal of claim 1 wherein the base of said nut has inwardly-projecting anchoring means for preventing outward movement of inserted wires.

5. The wire terminal of claim 4 wherein said anchoring means include integral inwardly-projecting flexible tabs.

6. The wire terminal of claim 1 wherein said spring is wound in a counter-clockwise direction.

7. The wire terminal of claim 1 wherein said spring is wound in a clockwise direction.

8. The wire terminal of claim 1 wherein said spring has a parallel upper portion and a conical lower portion.

9. The wire terminal of claim 8 wherein said spring is open-ended and wherein said terminal cavity extends above said open-ended spring.

10. The wire terminal of claim 1 wherein said spring is electrically conductive.

* * * * *